US005614306A

United States Patent [19]

Jobe et al.

[11] Patent Number: 5,614,306

[45] Date of Patent: Mar. 25, 1997

[54] CONDUCTIVE FABRIC AND METHOD OF PRODUCING SAME

[75] Inventors: Anthony Jobe, Union City; Cheryl A. Perkins, Roswell; Michael D. Powers, Woodstock, all of Ga.

[73] Assignee: Kimberly-Clark Corporation, Neenah, Wis.

[21] Appl. No.: 443,140

[22] Filed: May 17, 1995

Related U.S. Application Data

[62] Division of Ser. No. 816,403, Dec. 31, 1991, abandoned.

[51] Int. Cl.[6] ..... D04H 1/58

[52] U.S. Cl. ..... 442/381; 156/167; 156/176; 156/180; 442/382

[58] Field of Search ..... 428/286, 288, 428/340; 156/167, 176, 180

[56] References Cited

U.S. PATENT DOCUMENTS

| | | | |
|---|---|---|---|
| 3,565,729 | 2/1971 | Hartmann | 156/441 |
| 3,692,618 | 9/1972 | Dorschner et al. | 161/72 |
| 3,821,021 | 6/1974 | McMillin | 117/135.5 |
| 3,849,241 | 11/1974 | Butin et al. | 161/169 |
| 3,959,421 | 5/1976 | Weber et al. . | |
| 4,082,887 | 4/1978 | Coates | 428/289 |
| 4,100,324 | 7/1978 | Anderson et al. . | |
| 4,196,245 | 4/1980 | Kitson et al. . | |
| 4,215,682 | 8/1980 | Kubik et al. . | |
| 4,234,652 | 11/1980 | Vanoni et al. . | |
| 4,379,192 | 4/1983 | Wahlquist et al. . | |
| 4,405,297 | 9/1983 | Appel et al. | 425/72 S |
| 4,426,417 | 1/1984 | Meitner et al. . | |
| 4,429,001 | 1/1984 | Kolpin et al. . | |
| 4,433,024 | 2/1984 | Eian . | |
| 4,622,259 | 11/1986 | McAmish et al. . | |
| 4,623,576 | 11/1986 | Lloyd et al. . | |
| 4,650,479 | 3/1987 | Insley . | |
| 4,681,801 | 7/1987 | Eian et al. . | |
| 4,753,843 | 6/1988 | Cook et al. . | |
| 4,797,318 | 1/1989 | Brooker et al. . | |
| 4,820,572 | 4/1989 | Killian et al. . | |
| 4,865,755 | 9/1989 | Lloyd . | |
| 4,931,355 | 6/1990 | Radwanski et al. . | |
| 4,933,229 | 6/1990 | Insley et al. . | |
| 4,950,531 | 6/1990 | Radwanski et al. . | |

FOREIGN PATENT DOCUMENTS

| | | | |
|---|---|---|---|
| 0498002 | 8/1992 | European Pat. Off. | B01D 39/16 |
| 2194255 | 7/1987 | United Kingdom . | |
| WO87/05952 | 10/1987 | WIPO | D04H 3/16 |

OTHER PUBLICATIONS

NRL Report 4364, "Manufacture of Superfine Organic Fibers" by V. A. Wente, E. L. Boone and C. D. Fluharty May 1954.

NRL Repor 5265, "An Improved Device for the Formation of Superfine, Thermoplastic Fibers" by K. D. Lawrence, R. T. Lukas and J. A. Young Feb. 1959.

AN 93–024159 and JP–A–4 352 875: Database WPIL, Week 9303, Derwent Publ. Ltd. Dec. 7, 1992 (Asahi Chem Ind. Co. Ltd.).

AN 92–429930 and JP–A–4 327 267: Database WPIL, Week 9252, Derwent Publ. Ltd. Nov. 16, 1992 (Asahi Chem Ind. Co. Ltd.).

*Primary Examiner*—Christopher Raimund
*Attorney, Agent, or Firm*—William D. Herrick

[57] ABSTRACT

Conductive meltblown fabrics are disclosed which have improved strength and hand over conventional conductive meltblown fabrics. Also disclosed is a process for spraying a solution containing a conductive agent into a molten stream of meltblown fibers before they are deposited onto a forming wire. By applying the solution onto the fibers before they are deposited onto the forming wire, the heat of the molten stream vaporizes the solvent carrying the conductive agent and thereby eliminates the need to subsequently dry the formed material. By eliminating the drying step, degradation of the strength and hardening of the hand of the material normally resulting from the wetting and drying of meltblown fabrics are avoided. There is also disclosed a conductive SMS laminate having a conductive meltblown layer sandwiched between two untreated and nonconductive spunbond layers.

24 Claims, 1 Drawing Sheet

CONDUCTIVE FABRIC AND METHOD OF PRODUCING SAME

This application is a divisional of application Ser. No. 07/816,403 entitled "Conductive Fabric and Method of Producing Same" and filed in the U.S. Patent and Trademark Office on Dec. 31, 1991 now abandoned.

TECHNICAL FIELD

The present invention relates to conductive nonwoven fabrics and processes for applying conductive agents to nonwoven fabrics. More particularly, the present invention relates to conductive nonwoven meltblown webs having improved tensile strength and to a process for applying a conductive agent to a meltblown web wherein subsequent drying of the material and its strength decreasing effects are eliminated. The present invention further relates to laminated fabrics which incorporate a conductive meltblown layer.

BACKGROUND OF THE INVENTION

Nonwoven fabrics are well known in the art and are popular for use in the medical field. Doctors commonly wear masks and gowns made from nonwoven fabrics, and operating and diagnostic rooms are typically equipped with drapes, towels and the like which are made from nonwoven fabrics. In order for such items to be suitable for use in a surgical environment they should be strong to resist rupture and have good electrical conductivity to prevent the build-up of static electricity and hence the sparking resulting from the discharge of static electricity. Conductive fabrics which reduce sparking are particularly desirable in a surgical environment because sparking poses a danger of explosion when pure oxygen is used in the operating room.

In this regard, it is known in the art to treat nonwoven fabrics with conductive agents to render the material conductive and thereby reduce the build-up of static electricity. This is typically accomplished by spraying or otherwise applying an aqueous solution of a conductive agent onto the nonwoven material after it has been formed and then drying the material by passing it over steam cans to remove the residual water. One example of such a process is shown in U.S. Pat. No. 4,379,192 to Walquist et al. and assigned to Kimberly-Clark Corporation, the assignee of the present application. Conventional application methods which apply the conductive agent to the formed material and which require subsequent drying of the material need improvement because drying a nonwoven material to remove residual water is detrimental to the strength and hand of the material.

It is also known to apply a conductive agent to nonwoven fabrics using conventional printing methods. Printing allows the conductive agent to be applied without the need for additional drying steps; however, printing is not a commercially feasible method for applying conductive agents because it does not provide a uniform concentration of the agent at the high line speeds of modem material producing operations.

Accordingly, there is a need in the art for a method of applying a conductive agent to a nonwoven material in a commercial operation which does not require subsequent drying of the material and therefore does not decrease the strength and other qualities of the material.

SUMMARY OF THE INVENTION

The present invention fills the above need by providing a process for introducing a conductive agent into a molten polymer fiber stream prior to deposition of the fibers onto a forming wire or onto a spunbond web on a forming wire whereby a conductive meltblown web having improved strength is produced. By introducing the conductive agent into the molten stream of fibers, the bulk of the water is vaporized before the web is formed. In this manner subsequent drying of the web and the associated loss in strength is avoided.

Generally described, the present invention provides a method for producing a conductive meltblown web. The method comprises the steps of meltblowing a thermoplastic polymer to form fibers, introducing a conductive agent onto the fibers, and depositing the fibers onto a traveling wire to form the conductive meltblown web.

In addition, the present invention encompasses a conductive laminate formed of a conductive meltblown web formed as previously described, which conductive web is sandwiched between two nonconductive spunbond webs. The resulting SMS laminate exhibits the conductivity of the internal meltblown layer.

Thus, it is an object of the present invention to provide an improved conductive material and an improved process for producing conductive material.

A further object of the present invention is to provide a process for producing a conductive nonwoven material which has improved tensile strength.

A still further object of the present invention is to provide a process for applying a conductive agent to form a conductive nonwoven material which does not require subsequent drying.

It is yet another object of the present invention to provide a conductive meltblown web which has improved strength and hand.

It is also an object of the present invention to provide a conductive SMS laminate comprised of a conductive meltblown internal layer and nonconductive external spunbond layers.

DETAILED DESCRIPTION OF A PREFERRED EMBODIMENT

Figure 1:
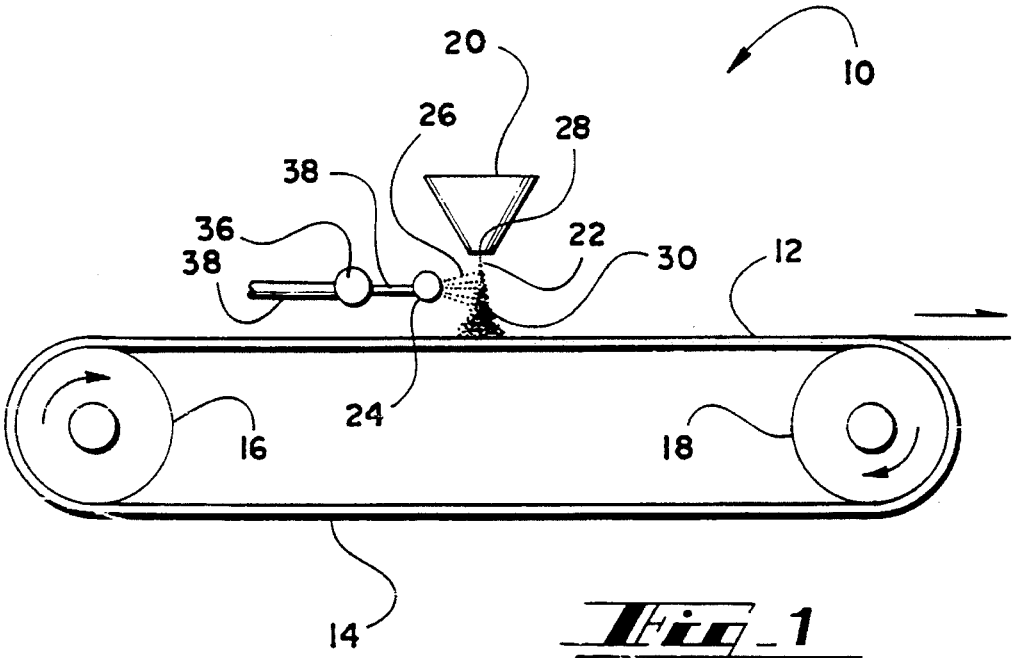
FIG. 1 is a schematic diagram of a forming machine which is used in making a conductive meltblown material having improved tensile strength in accordance with the present invention.

Turning to FIG. 1, there is shown a schematic diagram of a forming machine 10 which is used to produce a conductive meltblown material 12 in accordance with the present invention. Particularly, the forming machine 10 consists of an endless forming wire 14 wrapped around rollers 16 and 18 so that the belt 14 is driven in the direction shown by the arrows associated therewith. The forming machine 10 also includes a meltblowing station 20 for producing a molten stream of meltblown fibers 22 and a spray boom 24 for introducing a solution 26 of a conductive agent onto the meltblown fibers 22 before they are deposited on the forming wire 14.

The meltblowing station 20 consists of a conventional die 28 which is used to form the molten stream of meltblown fibers 22 from thermoplastic polymers or copolymers in a manner well known in the art. In accordance with the present invention the fibers 22 are sprayed with the solution 26 in a manner which will be described more fully below to produce sprayed fibers 30. The sprayed fibers 30 are then deposited on the forming wire 14 to provide the conductive material 12. The construction and operation of the meltblowing station 20 for forming fibers for depositing onto a forming wire is considered conventional, and the design and operation is well within the ability of those of ordinary skill in the art. Such skill is demonstrated by NRL Report 4364, "Manufacture of Super-Fine Organic Fibers," by V. A. Wendt, E. L. Boon, and C. D. Fluharty; NRL Report 5265, "An Improved Device for the Formation of Super-Fine Thermoplastic Fibers," by K. D. Lawrence, R. T. Lukas, and J. A. Young; and U.S. Pat. No. 3,849,241 issued Nov. 19, 1974 to Buntin et al. It will be appreciated, however, that other meltblown processes which can be modified to introduce a solution of a conductive agent into a molten stream of fibers may be suitable for use with the present invention. In addition, the conductive meltblown material 12 which is ultimately formed can be combined or laminated to other supporting fabrics, such as spunbonded webs, in order to impart strength or other attributes to the product.

Figure 2:
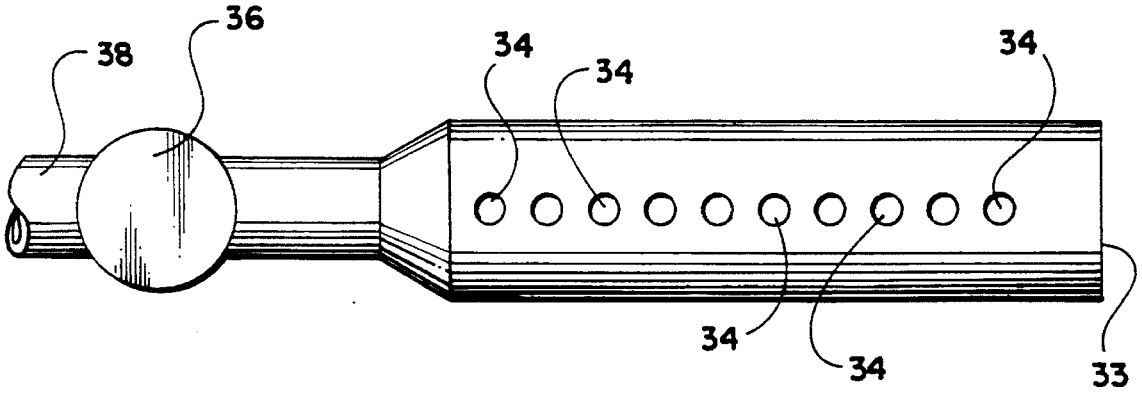
FIG. 2 is a side elevational view of a spraying apparatus which is use to spray a conductive agent into a molten stream of fibers in accordance with the present invention.

The solution 26 containing the conductive agent and a solvent, (usually water) is sprayed into the molten stream of fibers 22 using spray boom 24. The sprayed fibers are identified by reference numeral 30. Referring to FIG. 2, the spray boom 24 includes a tubular member 32 having a capped end 33 and a plurality of holes or nozzles 34 formed along its length. The length of the tubular member should be sufficient to spray the entire molten stream of fibers 22. A pump 36 transports the solution 26 from a supply (not shown) via a conduit 38 and through the tubular member 32 and out the holes 34 to introduce the solution into the molten stream of fibers 22. The sprayed fibers 30 are then deposited on the forming wire 14 to provide the conductive material 12. Because the conductive agent is introduced into the molten stream of fibers 22, the bulk of the solvent from the solution is vaporized such that the material 12 does not require subsequent drying.

Many sprayer devices may be utilized to introduce the solution 26 into the molten stream of fibers 22, it being understood that consideration should be given to match hole sizing, hole spacing, concentration of the conductive agent, and delivery pressure to achieve a relatively uniform, dry material which exhibits antistatic properties. Successful application has resulted using a spray boom having the characteristics listed in Table 1 in connection with conventional meltblowing apparatus having an operating temperature of between about 550° F. to 640° F. and an air pressure of between about 18 to 24 SCFM/inch.

TABLE 1

| Component | Preferred Range |
|---|---|
| Tubular Member 32 | 0.5–2.0 inch in diameter; schedule 40 stainless steel or aluminum |
| Holes 34 | 0.01–0.012 inch in diameter at 1–3 inch centers |
| Volume | 0.2 to 0.6 gal/min/boom |
| Pressure | 15 to 60 psig |
| Pump 36 | gear type positive placement; diaphragm (with surge suppressor), centrifugal. |
| Nozzles 34 | flat fan or jet spray |

The conductive agent used to make the solution 26 is preferably a pH adjusted alcohol phosphate salt such as potassium butyl phosphate available from DuPont under the trade name Zelec® TY. For most applications, it has been experienced that the solution 26 should be an aqueous solution having the conductive agent present in an amount greater than 1.5 percent by weight of the solution. This concentration of the conductive agent provides the material 12 with conductive agent in an amount greater than 0.015% by weight of the nonwoven fabric which provides suitable conductive properties for a variety of medical applications.

By using the forming machine 10 to produce the conductive material, the resulting conductive material 12 has a uniform concentration of the conductive agent and has improved tensile strength over conventionally prepared fabrics which have been dried to remove residual solvent. The present invention provides a process whereby a conductive agent may be applied without subsequent drying of the material. This is achieved by introducing the solution of the conductive agent into the molten stream of fibers before they are deposited on the forming wire. The heat of the molten stream thus vaporizes the solvent such that the formed material does not require subsequent drying. Because of this, loss of strength attributable to the action of wetting and drying the material is avoided. It has also been experienced that fabrics produced in accordance with the present invention have additional advantages. These advantages include softer hand, lesser cost, less drying of the wearer's skin and less heat shrinkage of the fabric.

It has also been found that when the conductive meltblown web is laminated with untreated spunbond webs that the resulting spunbond/meltblown/spunbond web (SMS) also exhibits desirable conductivity. Spunbonded nonwoven webs are generally defined in numerous patents including, for example, U.S. Pat. No. 3,565,729 to Hartmann, dated Feb. 23, 1971; U.S. Pat. No. 4,405,297 to Appel and Morman, dated Sep. 20, 1983; and U.S. Pat. No. 3,692,618 to Dorschner, Carduck, and Storkebaum, dated Sep. 19, 1972. SMS laminates with an internal conductive meltblown layer are particularly useful for surgical garments, sterilization wrap and control cover gowns.

The present invention is illustrated by the following examples:

EXAMPLE 1

A 0.45 ounce per square yard (osy) meltblown web was formed of polypropylene fiber and treated with a pH adjusted aqueous solution of Zelec® TY in accordance with the present invention. The aqueous solution was sprayed onto the molten fibers from a boom extending the width of the meltblown die head and having 0.010 inch diameter holes on 1½ inch centers. Three separate aqueous solutions of Zelec® TY were prepared having the concentrations by weight set forth in Table 2. When the solutions were sprayed on the meltblown fibers, the resulting meltblown webs had the add-ons by weight of the meltblown webs shown in Table 2.

TABLE 2

| Solution Concentration (% weight) | Add-on (% weight of meltblown web) |
|---|---|
| 1.5 | 0.09 |
| 2.5 | 0.13 |
| 3.25 | 0.18 |

The spray rate was 0.10 gallons per minute and the residual water in the meltblown web was from 0.50% to 1.0% by weight of the web after the meltblown web was formed. The three resulting meltblown webs were then laminated between two untreated spunbond webs of polypropylene filaments each having a basis weight of 0.50 osy. The add-on weights of pH adjusted Zelec® TY for the three SMS laminates varied from 0.03% to 0.06% by weight of the SMS laminate. The SMS laminates were tested for static decay and resistivity in accordance with Federal Test Method (FTM) 4046. The static decay values for the sample SMS laminates were all 0.01 second. The surface resistivity varied from $10^{10}$ to $10^{14}$ ohms/cm. In order to be considered conductive, a fabric must have a decay time less than 0.50 seconds and a surface resistivity less than $10^{14}$ ohms/cm.

As noted the conductive SMS laminate of the present invention is particularly useful as a sterilization wrap for wrapping surgical instruments and a cover gown for use in nonsterile fields in medical facilities. A sterilization wrap made in accordance with the present invention has a basis weight from approximately 1.4 osy to 2.6 osy with the conductive meltblown layer having a basis weight of approximately 0.45 osy. A cover gown made in accordance with the present invention has a basis weight of approximately 1.1 osy with the conductive meltblown layer having a basis weight of approximately 0.35 osy.

The foregoing description relates to preferred embodiments of the present invention, and modifications or alterations may be made without departing from the spirit and scope of the invention as defined in the following claims.

We claim:

1. A method for producing a conductive meltblown web, said method comprising the steps of:

(a) meltblowing a molten thermoplastic polymer to form fibers;

(b) introducing a conductive agent onto said fibers while said fibers are molten; and (c) depositing said fibers onto a traveling forming wire to form the conductive meltblown web having a static decay value of less than 0.50 seconds and surface resistivity less than $10^{14}$ ohms/cm.

2. The method of claim 1, wherein said conductive agent is introduced by spraying a solution containing said conductive agent onto said fibers before they are deposited onto said forming wire.

3. The method of claim 2, wherein said solution comprises an aqueous solution.

4. The method of claim 2, wherein said conductive agent is present in said solution in an amount of greater than 1.5 percent by weight of said solution.

5. The method of claim 2, wherein said conductive agent consists essentially of an alcohol phosphate salt.

6. The method of claim 5, wherein said salt comprises potassium butyl phosphate.

7. A method for producing a conductive laminate, said method comprising the steps of:

(a) meltblowing a molten thermoplastic polymer to form fibers;

(b) introducing a conductive agent onto said fibers while said fibers are molten;

(c) depositing said fibers onto a traveling forming wire to form a conductive meltblown web; and (d) laminating the conductive meltblown web to at least one untreated nonwoven web of thermoplastic fibers to form a conductive laminate having a static decay value less than 0.50 seconds and surface resistivity less than $10^{14}$ ohms/cm.

8. The method of claim 7, wherein said conductive agent is introduced by spraying a solution containing said conductive agent onto said fibers of the meltblown web before the fibers are deposited onto said forming wire.

9. The method of claim 8, wherein said solution comprises an aqueous solution.

10. The method of claim 8, wherein said conductive agent is present in said solution in an amount of greater than 1.5 percent by weight of said solution.

11. The method of claim 8, wherein said conductive agent consists essentially of an alcohol phosphate salt.

12. The method of claim 11, wherein said salt comprises potassium butyl phosphate.

13. A conductive meltblown web made in accordance with the method of claim 1.

14. A conductive meltblown web made in accordance with the method of claim 2.

15. A conductive meltblown web made in accordance with the method of claim 3.

16. A conductive meltblown web made in accordance with the method of claim 4.

17. A conductive meltblown web made in accordance with the method of claim 5.

18. A conductive meltblown web made in accordance with the method of claim 6.

19. A conductive meltblown laminate made in accordance with the method of claim 7.

20. A conductive laminate made in accordance with the method of claim 8.

21. A conductive laminate made in accordance with the method of claim 9.

22. A conductive laminate made in accordance with the method of claim 10.

23. A conductive laminate made in accordance with the method of claim 11.

24. A conductive laminate made in accordance with the method of claim 12.

* * * * *